US006580058B2

(12) United States Patent
Grätz et al.

(10) Patent No.: US 6,580,058 B2
(45) Date of Patent: Jun. 17, 2003

(54) COOKTOP WITH TEMPERATURE SENSOR

(75) Inventors: Franz Grätz, Traunwalchen (DE); Uwe Has, Unterneukirchen-Oberschroffen (DE); Dan Neumayer, Bernau (DE); Markus Theine, Freilassing (DE); Peter Vetterl, Grabenstätt (DE); Monika Zeraschi, Traunreut (DE)

(73) Assignee: BSH Bosch und Siemens Hausgeräte GmbH, Munich (DE)

( * ) Notice: Subject to any disclaimer, the term of this patent is extended or adjusted under 35 U.S.C. 154(b) by 0 days.

(21) Appl. No.: 10/223,040

(22) Filed: Aug. 16, 2002

(65) Prior Publication Data

US 2003/0024923 A1 Feb. 6, 2003

Related U.S. Application Data

(63) Continuation of application No. PCT/EP01/01145, filed on Feb. 2, 2001.

(30) Foreign Application Priority Data

Feb. 16, 2000 (DE) ..... 100 06 954

(51) Int. Cl.[7] ..... H05B 3/68
(52) U.S. Cl. ..... 219/448.11; 219/459.1
(58) Field of Search ..... 219/448.11, 448.19, 219/457.1, 458.1, 459.1, 460.1

(56) References Cited

U.S. PATENT DOCUMENTS 3,906,424 A * 9/1975 Clancy et al. ..... 337/394
4,447,710 A 5/1984 McWilliams
4,845,340 A * 7/1989 Goessler et al. ..... 219/448.19
4,851,645 A 7/1989 Wolf et al.
5,420,398 A * 5/1995 Petri et al. ..... 219/505
5,489,764 A * 2/1996 Mannuss et al. ..... 219/448.19
5,877,475 A 3/1999 Hecht et al.
6,229,119 B1 * 5/2001 Petri et al. ..... 219/448.11

FOREIGN PATENT DOCUMENTS

DE 37 03 768 A1 8/1988
DE 42 24 934 A1 2/1994
EP 0 021 107 A1 7/1981
EP 0 943 870 A1 9/1999

* cited by examiner

*Primary Examiner*—Sang Paik
(74) *Attorney, Agent, or Firm*—Laurence A. Greenberg; Werner H. Stemer; Ralph E. Locher

(57) ABSTRACT

In a cooktop having a cooktop panel, beneath which at least one heating element is disposed for heating up a vessel to be placed on the panel, and a temperature sensor sensing temperature of the underside of the panel within the heating element and connected to a control unit for controlling heating power of the heating element, to make assembly/fitting of the unit easier, the temperature sensor is fastened to an element extending from a region inside the heating element into a region outside the heating element, the element having a receiving portion inside the heating element for the temperature sensor and a fitting portion for fastening of the element, in particular, to the heating element, and/or a connection portion for connecting at least an electrical line from outside the heating element, which receiving portion lies radially offset laterally with respect to the fitting portion or connection portion.

19 Claims, 3 Drawing Sheets

COOKTOP WITH TEMPERATURE SENSOR

CROSS-REFERENCE TO RELATED APPLICATION

This application is a continuation of copending International Application No. PCT/EP01/01145, filed Feb. 2, 2001, which designated the United States and was not published in English.

BACKGROUND OF THE INVENTION

Field of the Invention

The present invention relates to a cooktop or hob with a cooktop panel, beneath which at least one heating element is disposed for heating up a cooking vessel that can be placed on the cooktop panel, and with a temperature sensor for sensing the temperature of the cooktop panel, and also relates to a corresponding heating element and a suitable element.

German Patent DE 37 03 768 C2, corresponding to U.S. Pat. No. 4,851,645 to Wolf et al. discloses a cooktop having a device for sensing the temperature of a glass-ceramic panel heated up by heating windings or halogen lamps with a temperature sensor. The sensor emits a signal corresponding to the temperature of the glass ceramic for a control circuit. The heating windings or halogen lamps are disposed in the interior space of a cup-like insulating base and heat up the glass-ceramic panel by direct radiation. The edge of the insulating base bears under resilient stress against the underside of the glass-ceramic panel, and the temperature sensor is disposed outside the interior space of the insulating base, but within the heating element. The temperature sensor is also in heat-conducting connection with the underside of the glass-ceramic panel, the temperature sensor being disposed in a receptacle in the edge of the insulating base. The receptacle is disposed at a distance x from the inner side of the edge of the insulating base, the minimum value of which is chosen such that the brief temperature changes arising when the heating windings or halogen lamps are switched on and off have only a negligible influence on the temperature sensor. The maximum value of the distance x is chosen such that the delay caused by the thermal conductivity of the glass-ceramic panel produces a small hysteresis in the control characteristic. Widths of from 3 mm to 6 mm have proven to be advantageous as the distance x. The temperature sensor is fitted in the receptacle that has been made or pressed into the upper side of the attachment that protrudes into the interior space of the insulating base, and is in heat-conducting connection with the underside of the glass-ceramic panel. The temperature sensor is held indirectly under resilient stress against the underside of the glass-ceramic panel, to keep the heat transfer resistance between the glass-ceramic panel and the temperature sensor small.

Furthermore, European Patent Application EP 0 021 107 A1 discloses a heating element for a cooking unit with a temperature sensor. To maintain complete heating of the entire surface area of the heating element, and, nevertheless, couple the temperature sensor of the controller closely to the heating device, a heat-transfer element in the form of a metal sheet is used, the sheet being disposed between the heating elements and the glass-ceramic panel such that it partly covers the heated region, but protrudes from the heating element and is in connection there with the temperature sensor of the controller. The heat-transfer element is fastened by secure clamping on the edge of the shell carrying the heating device and normally bears against the underside of the glass-ceramic panel. An outer portion protrudes from the heat-sensing region of the heat-transfer element outward beyond the edge of the heating element. It is formed in one piece with the aforementioned region, is substantially parallel to the latter, but offset downward somewhat by a bend, so that the outer portion does not bear against the underside of the glass-ceramic panel. The sensor cell of the temperature sensor is pressed by a compression spring against the underside of the heat-transfer face of the heat-transfer element, which is supported on a holding mechanism that guides the sensor cell and is attached to the outer portion of the heat-transfer element. However, other types of sensor and ways of attaching it are also possible. For example, an electrical NTC or PTC sensor, which is pressed resiliently into contact or securely attached to the outer portion of the heat-transfer element, may also be used. The transfer element can be grounded if desired, providing protection against electric shock.

Furthermore, the U.S. Pat. No. 4,447,710 to McWilliams discloses a glass-ceramic cooktop in which an insulator on which a temperature sensor, for example, a thermocouple, is mounted is disposed in the edge region of the heating element. The thermocouple is kept in good thermal contact with the underside of the glass-ceramic panel by the insulating block.

SUMMARY OF THE INVENTION

It is accordingly an object of the invention to provide a cooktop with temperature sensor and a corresponding heating element that overcome the hereinafore-mentioned disadvantages of the heretofore-known devices of this general type and that has good measuring accuracy while being easy to fit.

With the foregoing and other objects in view, there is provided, in accordance with the invention, a cooktop, including a cooktop panel having an underside, at least one heating element disposed beneath the cooktop panel for heating up a cooking vessel to be placed on the cooktop panel, the at least one heating element having an inside, a control unit electrically connected to the at least one heating element for controlling a heating power of the at least one heating element, a temperature sensor sensing a temperature of the underside of the cooktop panel within the at least one heating element, the temperature sensor electrically connected to the control unit, an element extending from the inside of the at least one heating element to a region outside the at least one heating element, the element having at least one of a receiving portion disposed at the inside of the at least one heating element and receiving the temperature sensor, a fitting portion for fastening the element to the at least one heating element, and a connection portion to be connected to an electrical line disposed outside the at least one heating element, the receiving portion being radially offset laterally with respect to one of the fitting portion and the connection portion, and the temperature sensor fastened to the element.

The invention provides a cooktop in which the temperature sensor is fastened to an element that extends from a region inside the heating element into a region outside the heating element, the element has a receiving portion inside the heating element for the temperature sensor and a fitting portion for the fastening of the element, in particular, to the heating element, and/or a connection portion for the connection at least of an electrical line respectively outside the heating element, which receiving portion lies radially offset laterally with respect to the fitting portion or connection portion. According to the invention, a corresponding heating element and also an element for the heating element are further provided. Due to the construction according to the invention, the relative position of the temperature sensor with respect to the element and their heat-conducting behavior can be precisely fixed and a structural unit that can be pre-assembled and pre-tested and is also easy to handle technically in terms of assembly/fitting, because it is quite large, is provided. When fitting the configuration on the heating element, it only remains to ensure error-free fastening of the heat-conducting element to the heating element. The thermal coupling of the heat-conducting element to the underside of the cooktop panel within the heating element and the simultaneous fastening of the temperature sensor to the element have the effect that the temperature sensor is optimally coupled to the cooktop panel or to a cooking pot placed thereon, while also being easy to position and easy to fit.

In accordance with another feature of the invention, the temperature sensor is disposed in the region of a temperature limiter of the heating element. As a result, on one hand, all the electrical connections can be disposed spatially together in a way that is favorable technically in terms of assembly/fitting and, on the other hand, the respective minimum distances of the electrical connections from one another are reliably maintained in conformity with the relevant VDE (German association of electrical engineers) regulations. The temperature limiter has the effect that the fitting space in the region of the outer circumferential wall of the heating element is limited, but, on the other hand, it is favorable if the various electrical connections of the temperature limiter and of the temperature sensor lie as close together as technical safety considerations allow.

In accordance with a further feature of the invention, to allow the element to be fitted quickly and without any errors, the heat-conducting element is fastened, in particular, screwed, in the region of the outer circumferential wall of the heating element or of the insulating base directly or with the aid of an intermediate fitting part. In such a case, it may be provided, in particular, that the intermediate fitting part is fastened in the bottom of the insulating base of the heating element and extends into the region of the outer circumferential wall of the heating element, in which the element is, in turn, screwed to the intermediate fitting part. To allow good setting of the bearing pressure or bearing area of the element, and consequently, inter alia, the thermal coupling of the element to the underside of the cooktop panel, the element can be screwed on the outer circumferential wall of the heating element at various heights.

In accordance with an added feature of the invention, the temperature sensor is fastened on the underside of the element. As a result, on one hand, a large planar resting area can be realized, to improve the heat conduction from the underside of the glass ceramic panel to the temperature sensor. On the other hand, the temperature sensor is mechanically protected better by the element of a larger surface area in the fitting process, for example, in the event of the element/temperature sensor unit falling down.

In accordance with an additional feature of the invention, the element is advantageously formed in at least two parts. A receiving part for the temperature sensor is, in this case, of a softer material to allow the receiving part to be geometrically shaped optimally, with specific regard to technical aspects of the application and safety. The rest of the element may be of another material, a spring material being suitable, in particular, to allow the element to be pressed in a defined manner against the underside of the glass-ceramic panel.

In accordance with yet another feature of the invention, it is particularly favorable from technical aspects of production and assembly/fitting if the element is formed as a torsion spring, the torsion region of the spring element being provided substantially outside the heating element and consequently in a cooler region.

In accordance with yet a further feature of the invention, a particularly compact structural unit is produced if the spring is of a substantially L-shaped form.

In accordance with yet an added feature of the invention, the element is formed such that it is electrically conductive and is grounded to conform optimally to the safety regulations in a simple construction.

In accordance with yet an additional feature of the invention, to obtain adequate measuring accuracy, both the temperature sensor and the element are adequately shielded by an insulator against thermal radiation emanating from a heating device of the heating element.

In accordance with again another feature of the invention, to make fitting easier, and, in particular, for strain relief, the electrical lines of the temperature sensor are connected to a first connection portion of the element or a connection piece mounted there. In a corresponding way, the element may also have a second connection portion, to which a ground line of the element is connected.

With the objects of the invention in view, there is also provided a cooktop, including a cooktop panel having an underside, at least one heating element disposed beneath the cooktop panel for heating up a cooking vessel to be placed on the cooktop panel, the at least one heating element having an inside, a control unit electrically connected to the at least one heating element for controlling a heating power of the at least one heating element, a temperature sensor sensing a temperature of the underside of the cooktop panel within the at least one heating element, the temperature sensor electrically connected to the control unit, an element extending from the inside of the at least one heating element to a region outside the at least one heating element, the element having a receiving portion disposed at the inside of the at least one heating element and receiving the temperature sensor, a fitting portion for fastening the element to the at least one heating element, and a connection portion to be connected to an electrical line disposed outside the at least one heating element, the receiving portion being radially offset laterally with respect to one of the fitting portion and the connection portion, and the temperature sensor fastened to the element.

With the objects of the invention in view, in a cooktop having a cooktop panel with an underside, at least one heating element disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel within the at least one heating element, the temperature sensor electrically connected to the control unit, there is also provided a temperature sensor holder including an element extending from the inside of the at least one heating element to a region outside the at least one heating element, the element having a receiving portion disposed at the inside of the at least one heating element for fastening the temperature sensor thereat, and at least one of a fitting portion for fastening the element to the at least one heating element, and a connection portion to be connected to an electrical line disposed outside the at least one heating element, the receiving portion being radially offset laterally with respect to one of the fitting portion and the connection portion.

In accordance with again a further feature of the invention, the element is a removable part of the at least one heating element.

With the objects of the invention in view, in a cooktop having a cooktop panel with an underside, a control unit, and a temperature sensor electrically connected to the control unit and sensing a temperature of the cooktop panel, there is also provided a heater including at least one heating element having an inside, the at least one heating element to be disposed beneath the cooktop panel for heating up a cooking vessel to be placed on the cooktop panel, and to be electrically connected to the control unit for controlling a heating power of the at least one heating element, and an element extending from the inside of the at least one heating element to a region outside the at least one heating element, the element having at least one of a receiving portion disposed at the inside of the at least one heating element for fastening the temperature sensor thereat, a fitting portion for fastening the element to the at least one heating element, and a connection portion to be connected to an electrical line disposed outside the at least one heating element, the receiving portion being radially offset laterally with respect to one of the fitting portion and the connection portion.

Other features that are considered as characteristic for the invention are set forth in the appended claims.

Although the invention is illustrated and described herein as embodied in a cooktop with temperature sensor, it is, nevertheless, not intended to be limited to the details shown because various modifications and structural changes may be made therein without departing from the spirit of the invention and within the scope and range of equivalents of the claims.

The construction and method of operation of the invention, however, together with additional objects and advantages thereof, will be best understood from the following description of specific embodiments when read in connection with the accompanying drawings.

DESCRIPTION OF THE PREFERRED EMBODIMENTS

Figure 1:
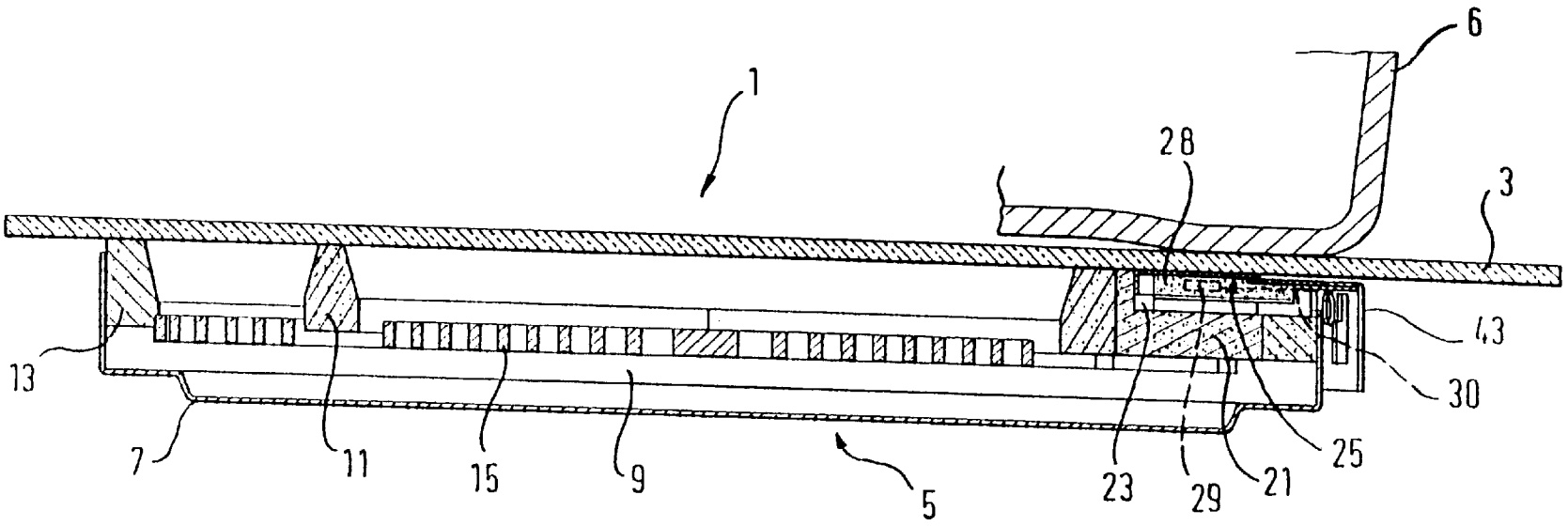
FIG. 1 is a fragmentary, cross-sectional view through line I—I in FIG. 2 of a cooktop with a heating element according to the invention.
Figure 2:
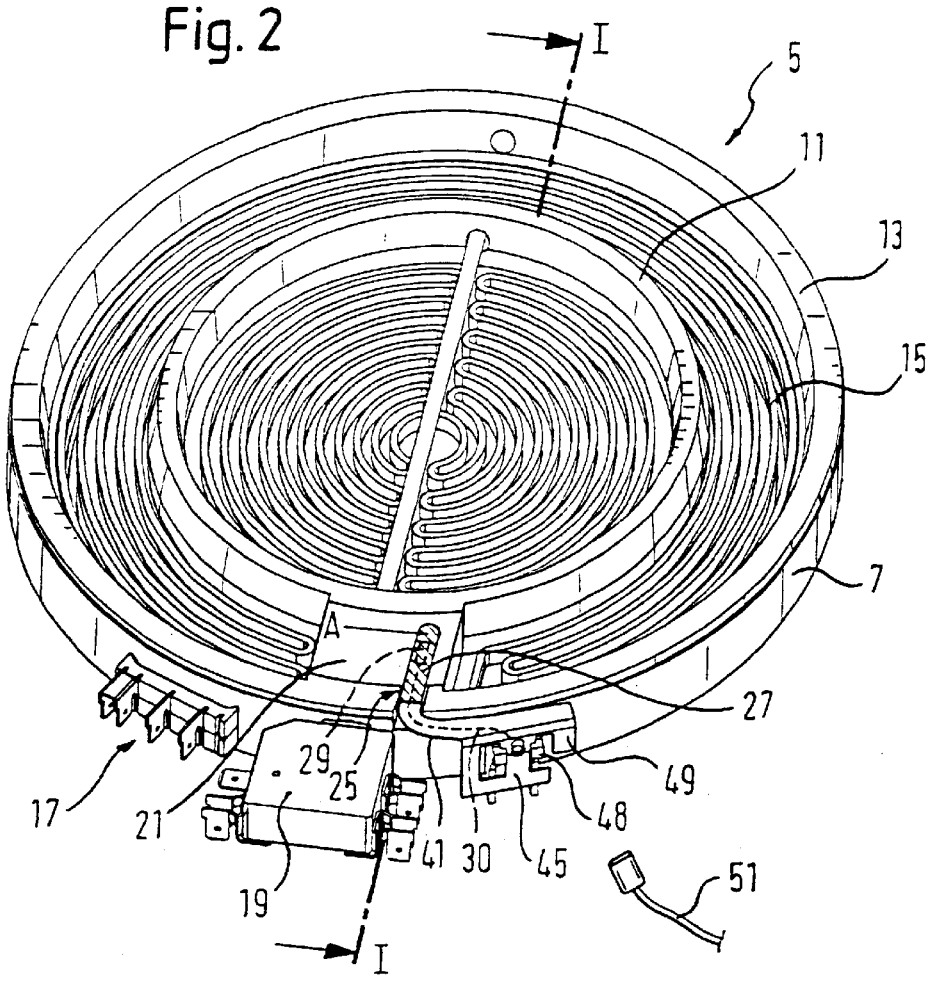
FIG. 2 is a partial fragmentary, perspective view from above of a heating element according to the invention.
Figure 3:
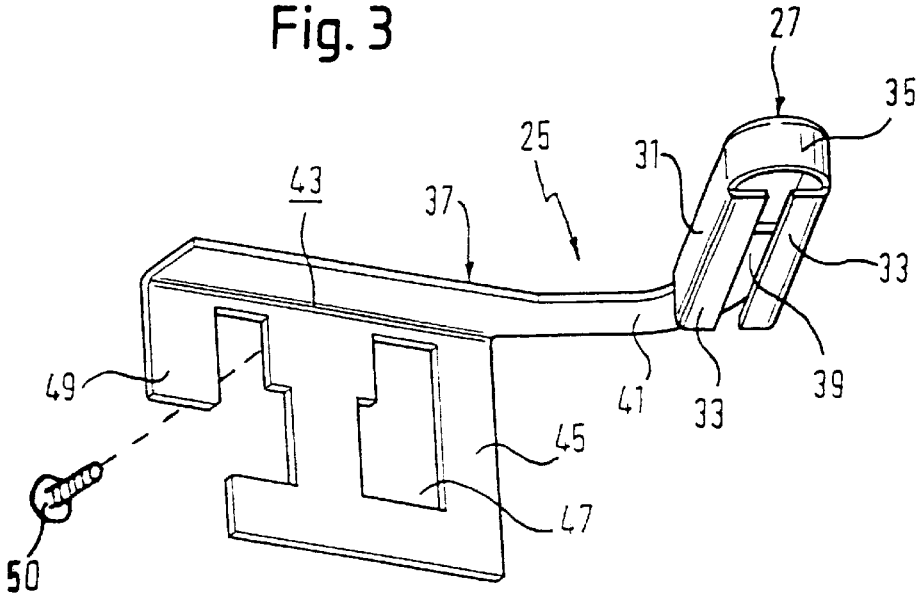
FIG. 3 is an enlarged, perspective view from below of a heat-conducting element from FIGS. 1 and 2 without a temperature sensor.

Referring now to the figures of the drawings in detail and first, particularly to FIG. 1 thereof, there is shown a cooktop 1 has a cooktop panel 3 (FIG. 1) made, in particular, of glass ceramic. Provided beneath the cooktop panel 3, in a conventional way, are various heating elements 5 of the cooktop, which are also pressed in a conventional way (not shown) against the underside of the cooktop panel 3. In the region of the heating element 5, the cooktop panel 3 is usually decorated appropriately on its upper side. In the heated region, a cooking vessel 6 can be placed. In the cold state, the bottom of the cooking vessel 6 often rests on the cooktop panel 3 only in an annular area in the edge region of the heating element 5, while in the remaining central region of the bottom of the pot it is kept at a distance away from the panel by an air gap (FIG. 1). In the heated state, the air gap is reduced or ideally approaches zero as a result of the conventional thermally induced movement of the bottom of the pot. The heating element 5 has a dish-like sheet-metal cup 7, in which a circular disk-shaped insulating panel 9 lies. Furthermore, an inner insulating ring 11 and an outer insulating ring 13 are provided within the sheet-metal cup 7, on the insulating panel 9, in a way corresponding to a two-circuit heating configuration. As a result, the interior space of the heating element 5 is separated into an inner heating region and an outer heating region, in which a strip heating conductor 15 respectively extends (FIG. 1, FIG. 2). In a conventional way, fastened in the region of the outer circumferential wall of the sheet-metal cup 7 is a heating-conductor connection part 17, which, on one hand, is connected in a conducting manner to the strip heating conductors 15 and, on the other hand, can be connected to non-illustrated electrical supply lines of the cooktop 1 (FIG. 2). The heating element 5 also has a conventional temperature limiter 19, the bar of which extends transversely over the heated region of the heating element. The connection block of the temperature limiter 19 has the conventional and customary, laterally brought-out flat contact pins for connection to the voltage supply line or to the heating-conductor connection part 17 of the heating element 5. An insulating block 21 is disposed between the inner insulating ring and the outer insulating ring 13 in the region of the temperature limiter 19. The insulating block 21 may serve the purpose of thermally shielding the temperature limiter 19 in the region of portions of the strip heating conductor 15 taken underneath the insulating block 21 with respect to the portions. A receiving depression 23 has been milled into the edge region of the insulating block 21, in the upper side thereof. In the depression 23, a heat-conducting element 25 is disposed with its element shroud 27 (FIGS. 1, 2, 3). It should be ensured, in this respect, that the shroud 27 does not rest directly on the bottom of the depression 23 so that the shroud 27 can yield slightly in the event of the cooktop panel 3 being subjected to impact. The yielding allows damage to or breakage of the panel 3 to be avoided, in particular, if it is made of glass or glass-ceramic material.

Figure 5:
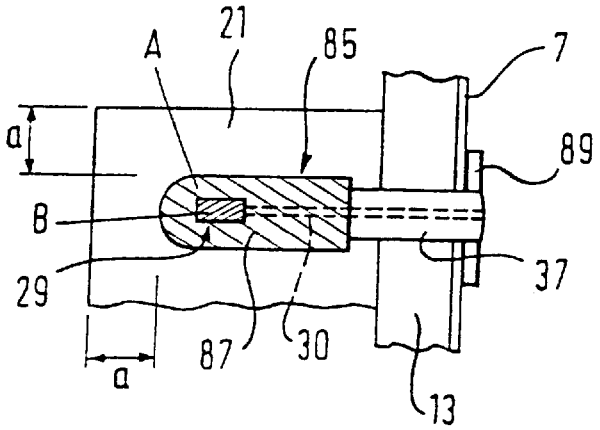
FIG. 5 is a simplified, fragmentary, cross-sectional view of a portion of a third embodiment of the heating element of FIGS. 1 and 2.

A PT-500 measuring sensor 29 is embedded with its sensor lines 30 in the receiving space formed by the element shroud 27, by a temperature-resistant and heat-conducting ceramic adhesive 28, and is fastened and guided in this way. The material of the element shroud 27 is X7 steel and the shroud 27 is configured in respect thereto as a bending part. The shroud material must have adequately good heat-conducting properties, must be able to deform well, as explained below, but be adequately stable mechanically in the entire temperature range of up to 350–400° C., and retain its properties even at these temperatures. From the portion of the element shroud 27 serving as a top wall there are two side walls 31 bent away downward substantially at right angles (FIG. 3). Likewise bent away at right angles with respect to the side walls 31, bottom walls 33 delimit a base of the element shroud 27 that is open in a slit-shaped manner. At the end face, the receiving space of the shroud is closed by an end wall 35, which is bent away at right angles from the top wall. It is ensured by the shroud-shaped configuration of the element 25 that the clearance and leakage distance from the live temperature sensor 29 prescribed by safety regulations are maintained in the event of breakage of the cooktop panel 3, without the base area of the element 25 or of the shroud 27, and, consequently, of the insulating block 21, having to be made all that large. More precise details on the geometrical shape and configuration of the temperature sensor 29, of the element 25, and of the insulating block 21 are given in connection with the description of the third exemplary embodiment, sketched in FIG. 5. The shroud 27 is securely connected, preferably, welded, to a steel shroud support 37, of a substantially L-shaped configuration. For such a purpose, the element shroud 27 is mounted on a connecting portion 39 of the shroud support 37 (FIG. 3). As a result, the top wall of the element shroud 27 is slightly elevated with respect to the upper side of the shroud support 37 and defines and delimits an area region A in which the element 25 bears in a heat-conducting manner against the underside of the cooktop panel 3 (FIGS. 1, 2, 5). The overlapping connection of the shroud 27 and shroud support 37 also increases the stability of the connection. While the shroud support 37 is of a material 0.8 mm thick, to conform to regulations for the plug-in grounding connections described below, the element shroud 27 is of thinner material, which additionally makes it easier to shape.

The shroud support 37 merges in a resilient portion 41 with a fitting portion 43 (FIGS. 2, 3). In this case, the resilient portion 41 is disposed substantially outside the heated region of the heating element 5 or of the outer insulating ring 13. The fitting portion 43 of the shroud support 37 has a fitting plate 45, which is bent away downward at right angles and has fitting openings 47. The fitting openings 47 allow the heat-conducting element 25 to be fastened adjustably in height on the outer circumferential wall of the sheet-metal cup 7 by an intermediate fitting part 48 (FIG. 2). For such a purpose, the intermediate fitting part 48 is, on one hand, screwed on the underside of the sheet-metal cup 7 in the base thereof (not illustrated). The fitting part 48 extends in an approximately L-shaped manner from the base of the heating element up to its side wall 7. In the side wall region, the heat-conducting element 25 is then screwed to (see, i.e., screw 50 in FIG. 3) the intermediate fitting part 48 and, consequently, the position of the heat-conducting element 25 can be fixed in a defined manner in terms of height. The configuration dispenses with the need for troublesome screwing openings in the side wall of the sheet-metal cup 7 and allows the openings that are always already present in the base of the sheet-metal cup to be used. Alternatively, the heat-conducting element 25 may, however, also be screwed to the outer wall of the sheet-metal cup 7 in the region of the fitting openings 47. It is also possible to fasten in the fitting openings 47 a non-illustrated connection part, to which, on one hand, the electrical sensor lines 30 of the temperature sensor 29 can be connected, for example, can be plugged on, and to which, on the other hand, electrical connecting lines of a control unit 101 (FIG. 6) of the cooktop 1 are connected. The connection provides reliable strain relief for the sensor lines 30. The connection part also ensures that the electrical connections of the PT temperature sensor 29 are insulated from ground and from the grounded shroud support 37. The temperature sensor and the sensor lines 30 are covered on the top side over their entire length by the heat-conducting element 25. For better guidance of the lines 30, they may be adhesively attached on the underside of the element 25 in the region of the shroud support 37 and/or be held by guiding elements formed on the support 37. Furthermore, the fitting plate 45 has a flat pin 49, on which a ground line 51 or its standardized AMP plug of the cooktop can be directly fitted. As a result, the heat-conducting element 25 is connected to ground potential. It must be ensured, in such a case, that the ohmic resistance of the element 25 lies at a value of 0.1 ohm or less, to be able to withstand a continuous current load of at least 25 A. Furthermore, the heat-conducting element 25 must also not be made too rigid, to allow it to yield suitably under mechanical loading or movement of the cooktop panel 3. Otherwise, excessively rigid abutment of the element 25 or the element shroud 27 against the cooktop panel 3 would give rise to the risk of the cooktop panel flaking away on the underside of the panel 3 or possibly even of it breaking. It should also be noted that an improvement in the heat conduction from the underside of the cooktop panel 3 to the heat-conducting element 25 could be achieved if the intermediate spaces between the studs formed on the underside of the glass-ceramic panel are filled with a heat-conducting paste or a suitable adhesive.

Figure 4:
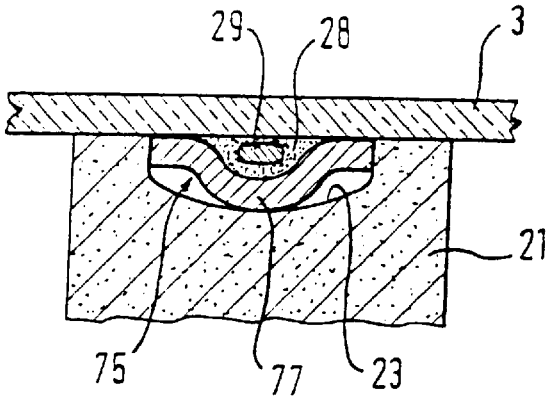
FIG. 4 is a simplified, fragmentary, cross-sectional view of a portion of a second embodiment of the heating element of FIGS. 1 and 2.

In the case of the cooktop or the heating element according to the second exemplary embodiment, the same reference numerals as in the case of the description of the first exemplary embodiment are used wherever possible for reasons of simplicity. In FIG. 4, the region of the cooktop in which the temperature sensor 29 is disposed together with a heat-conducting element 75 in the region of the insulating block 21, in a way similar to the first exemplary embodiment, is shown as a portion in a sectional representation transversely with respect to the longitudinal extent of the element and consequently approximately perpendicularly with respect to the line I—I in FIG. 2. By contrast with the first exemplary embodiment, the heat-conducting element 25 has no element shroud, but instead an element shell 77. The element shell 77 is likewise disposed in a suitable receiving depression 23 of the insulating block 21. The insulating shell 77 lies in its edge regions in an annular area directly against the underside of the glass-ceramic panel 3 and, as a result, is in heat-conducting connection with the panel 3. Disposed in the element shell 77 is the temperature sensor 29, the shell additionally being filled by a heat-conducting paste. The heat-conducting element 75, which is not shown in any more detail, could otherwise be formed in the same way as the heat-conducting element 25 of the first exemplary embodiment. For technical safety reasons, however, the temperature sensor 29 is operated with a safety extra-low voltage or transmits its measuring signal contactlessly from the heating element.

According to the third exemplary embodiment as shown in FIG. 5, the heat-conducting element 85, shaped, for example, in the form of a shroud, has an element shroud 87, which corresponds to that of the first exemplary embodiment. As in the first exemplary embodiment, a fitting portion 89 of the shroud support 37 is disposed radially offset laterally with respect to the receiving portion of the element shroud 87. In FIG. 5 it is schematically represented in which area region A the heat-conducting element 85 is thermally in contact with the underside of the cooktop panel 3. The size of the area is, in such a case, approximately 50 to 100 $mm^2$. It is also represented that the contact area A is approximately about 10 times larger than a base area B of the temperature sensor 29. As a result, it is ensured, inter alia, that the temperature on the underside of the cooktop panel is not determined by the temperature sensor as it were at a point, but in an integrating manner over a relatively large area region. This is important, in particular, because the respective pan diameter and the nature of its bottom are not precisely known and, in addition, may vary from pan type to pan type. A minimum lateral distance a of the element 85 from the edge region of the insulating material 21 is about 8 mm. Such a configuration provides an optimum geometry, which has the following advantages for the accurate control of the heating power or the temperature, in particular, in the case of frying of braising operations in pans 6 placed on the cooktop panel 3. The temperature sensor 29 and the element shroud 27 are, on one hand, adequately shielded by the insulating block 21 against the thermal radiation emanating from the strip heating conductor 15. On the other hand, the insulating block is still small enough to be able to avoid disadvantageous shadowing of the vessel bottom 6 during heating or frying/braising, and the resultant undesirably uneven heat distribution in the bottom of the pan. In particular, the heat-conducting element 25 is still thermally coupled adequately well to the region of the cooktop panel that is heated directly by the thermal radiation of the heating device 15. This is achieved moreover in the case of the first and third exemplary embodiments, the temperature sensor 29 at the same time being covered with respect to the cooktop panel 3 by a grounded protective element, shroud 27, while conforming to the 4 mm clearance and 8 mm leakage distance required by regulations. It is also achieved by the enlargement of the area thermally in contact with the underside of the cooktop panel 3 that, in spite of all assembly/fitting tolerances, adequately good thermal contact is established between the temperature sensor, of a smaller surface area, and the cooktop panel 3. This is important, in particular, whenever a glass-ceramic cooktop panel 3 that is studded on the underside is used and the geometry of the studs is of the same order of magnitude as the temperature sensor 29. The above statements concerning the shaping of the geometries, distances, and relative sizes apply to all three exemplary embodiments. If appropriate, the measuring area A is coupled by a high-temperature lubricant to the underside of the cooktop panel, which is, in particular, of glass-ceramic material, in order to achieve improved heat transfer and improved damping under impact loading.

Figure 6:
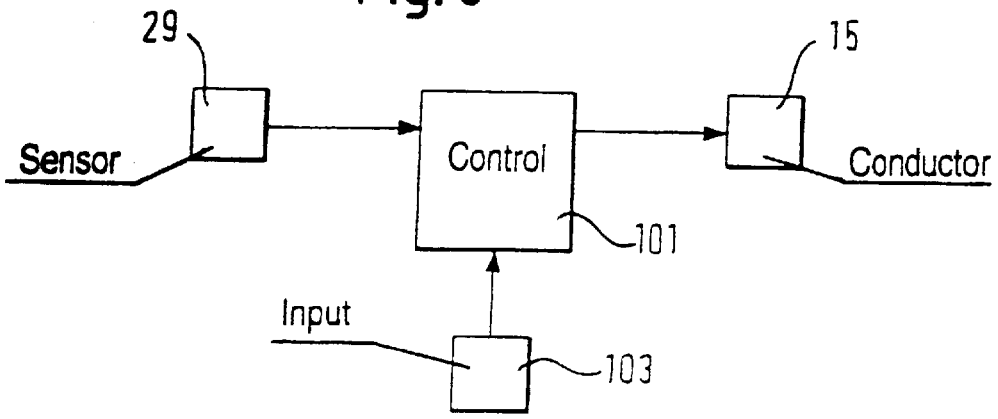
FIG. 6 is a block circuit diagram of the cooktop according to the invention.

A block diagram that shows the most important components of the cooktop is schematically shown in FIG. 6. The control unit 101 regulates the heating power of the strip heating conductor 15 in a way corresponding to the measured values of the temperature sensor 29 to the setpoint value predetermined by an input unit 103. The configuration achieves the effect, in particular, that burning during frying/braising is virtually ruled out.

We claim:

1. A cooktop, comprising:

a cooktop panel having an underside;

at least one heating element disposed beneath said cooktop panel for heating up a cooking vessel to be placed on said cooktop panel, said at least one heating element having an inside;

a control unit electrically connected to said at least one heating element for controlling a heating power of said at least one heating element;

a temperature sensor sensing a temperature of said underside of said cooktop panel within said at least one heating element, said temperature sensor electrically connected to said control unit;

an element extending from said inside of said at least one heating element to a region outside said at least one heating element, said element having at least one of:

a receiving portion disposed at said inside of said at least one heating element and receiving said temperature sensor;

a fitting portion for fastening said element to said at least one heating element; and a connection portion to be connected to an electrical line disposed outside said at least one heating element, said receiving portion being radially offset laterally with respect to one of said fitting portion and said connection portion; and said temperature sensor fastened to said element.

2. The cooktop according to claim 1, wherein:

said element has an underside; and said temperature sensor is fastened on said underside of said element.

3. The cooktop according to claim 1, wherein said element:

has said receiving portion; and is pressed in a region of said receiving portion onto said underside of said cooktop panel.

4. The cooktop according to claim 1, wherein:

said element is a torsion spring having a torsion region; and said torsion region is disposed substantially outside said at least one heating element.

5. The cooktop according to claim 4, wherein said torsion spring is substantially L-shaped.

6. The cooktop according to claim 1, wherein:

said at least one heating element has an outer circumferential wall; and said element is fastened at a region of said outer circumferential wall.

7. The cooktop according to claim 1, wherein:

said at least one heating element has an outer circumferential wall; and said element is fastened one of in and on a region of said outer circumferential wall.

8. The cooktop according to claim 1, wherein:

said at least one heating element has an outer circumferential wall; and said element is screwed onto a region of said outer circumferential wall.

9. The cooktop according to claim 1, wherein:

said at least one heating element has an outer circumferential wall; and at least one screw fastens said element at a region of said outer circumferential wall.

10. The cooktop according to claim 1, wherein:

said at least one heating element has a temperature limiter; and said temperature sensor is disposed in a region of said temperature limiter.

11. The cooktop according to claim 1, wherein:

said at least one heating element has a heater; and insulating material shields said temperature sensor and said element against thermal radiation emanating from said heater.

12. The cooktop according to claim 1, wherein:

said at least one heating element has a heater; and an insulator shields said temperature sensor and said element against thermal radiation emanating from said heater.

13. The cooktop according to claim 1, wherein said element has said fitting portion;

said element has an electrical connection portion in a region of said fitting portion;

said temperature sensor has at least one electrical line; and said at least one electrical line is connected to said electrical connection portion.

14. The cooktop according to claim 13, wherein said element has a ground connection portion in a region of said fitting portion to be connected to a ground line.

15. The cooktop according to claim 1, wherein:

said element has said fitting portion; and said connection portion is a ground connection portion disposed in a region of said fitting portion and to be connected to a ground line.

16. A cooktop, comprising:

a cooktop panel having an underside;

at least one heating element disposed beneath said cooktop panel for heating up a cooking vessel to be placed on said cooktop panel, said at least one heating element having an inside;

a control unit electrically connected to said at least one heating element for controlling a heating power of said at least one heating element;

a temperature sensor sensing a temperature of said underside of said cooktop panel within said at least one heating element, said temperature sensor electrically connected to said control unit;

an element extending from said inside of said at least one heating element to a region outside said at least one heating element, said element having:

a receiving portion disposed at said inside of said at least one heating element and receiving said temperature sensor;

a fitting portion for fastening said element to said at least one heating element; and a connection portion to be connected to an electrical line disposed outside said at least one heating element, said receiving portion being radially offset laterally with respect to one of said fitting portion and said connection portion; and said temperature sensor fastened to said element.

17. In a cooktop having a cooktop panel with an underside, at least one heating element disposed beneath the cooktop panel for heating up a cooking vessel to be placed on the cooktop panel, a control unit electrically connected to the at least one heating element for controlling a heating power of the at least one heating element, and a temperature sensor sensing a temperature of the underside of the cooktop panel within the at least one heating element, the temperature sensor electrically connected to the control unit, a temperature sensor holder comprising:

an element extending from the inside of the at least one heating element to a region outside the at least one heating element, said element having:

a receiving portion disposed at the inside of the at least one heating element for fastening the temperature sensor thereat; and at least one of:

a fitting portion for fastening said element to the at least one heating element; and a connection portion to be connected to an electrical line disposed outside the at least one heating element, said receiving portion being radially offset laterally with respect to one of said fitting portion and said connection portion.

18. The temperature sensor holding according to claim 17, wherein said element is a removable part of the at least one heating element.

19. In a cooktop having a cooktop panel with an underside, a control unit, and a temperature sensor electrically connected to the control unit and sensing a temperature of the cooktop panel, a heater comprising:

at least one heating element having an inside, said at least one heating element:

to be disposed beneath the cooktop panel for heating up a cooking vessel to be placed on the cooktop panel; and to be electrically connected to the control unit for controlling a heating power of said at least one heating element; and an element extending from said inside of said at least one heating element to a region outside said at least one heating element, said element having at least one of:

a receiving portion disposed at said inside of said at least one heating element for fastening the temperature sensor thereat;

a fitting portion for fastening said element to said at least one heating element; and a connection portion to be connected to an electrical line disposed outside said at least one heating element, said receiving portion being radially offset laterally with respect to one of said fitting portion and said connection portion.

* * * * *